US005715670A

United States Patent [19]

Bartkowiak

[11] Patent Number: 5,715,670

[45] Date of Patent: Feb. 10, 1998

[54] APPARATUS AND METHOD FOR COOLING AN ADVANCING YARN HAVING RELATIVE TRANSVERSE MOVEMENT BETWEEN THE YARN AND COOLING SURFACE

[75] Inventor: Klaus Bartkowiak, Herne, Germany

[73] Assignee: Barmag AG, Remscheid, Germany

[21] Appl. No.: 630,449

[22] Filed: Apr. 10, 1996

[30] Foreign Application Priority Data

Apr. 11, 1995 [DE] Germany ..... 195 13 725.6
Aug. 3, 1995 [DE] Germany ..... 195 28 566.2

[51] Int. Cl.[6] ..... D01H 5/00; D01H 7/46

[52] U.S. Cl. ..... 57/284; 57/290; 57/354

[58] Field of Search ..... 57/290, 249, 284, 57/352, 286, 292, 308, 354, 355, 356, 357, 351; 28/247, 249, 258

[56] References Cited

U.S. PATENT DOCUMENTS

| | | | |
|---|---|---|---|
| 4,809,484 | 3/1989 | Dammann . | |
| 5,148,666 | 9/1992 | Bauer et al. | 57/290 |
| 5,339,617 | 8/1994 | Dammann | 57/290 |
| 5,359,845 | 11/1994 | Gabalda et al. | 57/290 |
| 5,372,004 | 12/1994 | Yamamoto et al. | 57/290 |
| 5,406,782 | 4/1995 | Inuyama et al. | 57/284 |
| 5,438,820 | 8/1995 | Nakahara et al. | 57/290 |
| 5,578,231 | 11/1996 | Schippers et al. | 219/388 |

FOREIGN PATENT DOCUMENTS

| | | | |
|---|---|---|---|
| 38 01 506 | 8/1988 | Germany . | |
| 41 38 509 | 8/1992 | Germany . | |
| 43 09 179 | 9/1993 | Germany . | |
| 1321945 | 12/1989 | Japan | 57/284 |
| 5-117929 | 5/1993 | Japan | 57/284 |
| 5-331725 | 12/1993 | Japan | 57/284 |
| 5-331727 | 12/1993 | Japan | 57/284 |
| 564620 | 7/1975 | Sweden | 57/284 |
| 572537 | 2/1976 | Sweden | 57/289 |
| 1089183 | 4/1984 | U.S.S.R. | 28/247 |
| 772346 | 4/1957 | United Kingdom | 57/284 |

*Primary Examiner*—William Stryjewski
*Attorney, Agent, or Firm*—Bell Seltzer Intellectual Property Law Group of Alston & Bird LLP

[57] ABSTRACT

A cooling apparatus and method for cooling an advancing yarn, which includes an elongate cooling rail along which the advancing yarn is guided. At each end of the cooling rail, the yarn and the cooling rail are reciprocated relative to each other in a direction transverse to the direction of the advancing yarn, so that the yarn sweeps over the cooling surface of the cooling rail, thus facilitating the removal of a possibly developing condensate.

19 Claims, 4 Drawing Sheets

APPARATUS AND METHOD FOR COOLING AN ADVANCING YARN HAVING RELATIVE TRANSVERSE MOVEMENT BETWEEN THE YARN AND COOLING SURFACE

BACKGROUND OF THE INVENTION

The invention relates to an apparatus and method for cooling an advancing yarn and which is adapted for use in a false twist crimping operation for synthetic filament yarns.

To enable an effective heating or cooling of the yarn, known false twist crimping machines operating at high yarn speeds require heating and cooling rails, which occupy as a whole a considerable length and, thus, increase the floor space requirements of such machines. For limiting the overall height of the false twist crimping machine, it is known from DE 38 01 506 A1 to arrange a heating rail below the first feed system on the package creel facing the false twist crimping machine, and to provide a cooling rail that spans over the operator aisle in the fashion of a roof or a vault. Thus, an effective thermal treatment requires an adequately long treatment zone, which can be realized only when a reliable contact of the advancing yarn with the heating rail or the cooling rail is ensured.

DE 41 38 509 A1 discloses a cooling apparatus of the described kind for use on false twist crimping machines when texturing advancing synthetic filament yarns. This known cooling apparatus has two walls extending parallel to the advancing yarn and to one another. These walls form a narrow gap, but still permit a free passage of the yarn, thus forming a substantially closed chamber, so that the walls form the opening of an air chamber for compressed air or a vacuum, which extends along the path of the advancing yarn. In the outside of the thus-formed hollow profile, a gap or trough is provided for the passage and thus cooling of the yarn, so that air flowing out of or into this chamber forms an air jacket surrounding and thus cooling the yarn.

A further increase in the speed of the advancing yarn with the known apparatus is possible only by enlarging the length of the cooling apparatus which is covered by the yarn, or by increasing the cooling performance by, for example, a forced cooling of the advancing yarn. Such a forced cooling is connected with additional expenditure for equipment and energy. The cooling performance itself, which may be realized by a contact of the yarn with the surface of the cooling rail, is limited for physical reasons, and cannot easily be increased, for example, by raising the temperature gradient, since same may lead, for example to condensation or even icing.

A condensation cooling machine as disclosed in Japanese Application JP 05-117929 is likewise unable to fulfill the requirements in texturing processes operating at very high yarn speeds.

Since for the above reasons it is not possible to realize an increase in the length of the cooling surface by reason of the overall height limitation of the machine, and since reasons of energy do not permit an improvement of the heat transfer coefficient or temperature difference between cooling rail and surroundings, these restrictions effectively preclude a further increase in the speed of the advancing yarn.

It is accordingly an object of the invention to provide a cooling apparatus and a method, which are adapted for use as part of a false twist crimping machine, and which allow a more effective cooling of a yarn advancing over the cooling surface to be realized, without requiring that the surface temperature of the cooling surface be above the dew point temperature.

It is a further object of the invention to provide a cooling apparatus and a method, which prevent the yarn, as it advances over the cooling surface, from entering laterally into a wall of dirt, or an accumulation of water or ice.

SUMMARY OF THE INVENTION

The above and other objects and advantages of the present invention are achieved in the embodiments illustrated herein by the provision of an apparatus and method for cooling an advancing yarn which comprises an elongate cooling rail which defines a longitudinal direction and opposite ends, means for guiding the advancing yarn longitudinally along the cooling rail, and means for creating back and forth relative transverse movement between the yarn and the cooling rail adjacent each of the opposite ends of the cooling rail.

Accordingly, the apparatus and the method of the present invention permit the cooling performance of a cooling apparatus to be increased, with the advancing yarn passing over a substantially smooth surface of the cooling rail, in that the yarn and the cooling rail perform transverse movements relative to one another in the two end regions of the cooling rail. In so doing, the back and forth relative transverse movements between the advancing yarn and the cooling rail are preferably out of phase in the end regions, i.e. the back and forth movements at the two end regions are continuous and in opposite directions at the same time, thereby permitting the surface temperature of the cooling surface of the cooling apparatus to be decreased, if need be, to below the dew point, which is about 10° C. in climate controlled production rooms, or even below the freezing point, which is 0° C. Such a decrease of the surface temperature of the cooling apparatus permits an increase of the temperature difference between the cooling, rail and the yarn being cooled, and thus an increase of the heat transfer in combination with an improved heat transfer coefficient.

To utilize the improved cooling effect by falling below the 10° C. or 0° C. limit of the cooling temperature, the relative movement of the yarn and/or the cooling rail constitutes the motion of a pendulum. As result, high transformations of energy with a phase change may be utilized simultaneously.

The relative movement between the advancing yarn and the cooling surface of the cooling rail may be provided by a yarn deflection device, which allows a phase shift to be realized between a position of the yarn at the inlet end of the cooling rail and a position at the outlet end of the cooling rail. On the other hand, the phase shift may be realized in that the cooling rail is provided with a deflection device for realizing a phase shift between the respective position of the yarn in each end region of the cooling rail.

It is also possible that the yarn deflection device and/or the motion device for the cooling rail are controlled such that, at the position of the yarn entry into the cooling rail, the amplitude of the yarn movement is greater or smaller than the amplitude of the yarn movement at the exit from the cooling rail. Thus, the amplitude of the relative movement between the advancing yarn and the cooling apparatus defines the shape of the cooling apparatus, which can be adapted to the particular desired conditions or circumstances.

A specially preferred embodiment is provided when the phase shift between the position of the yarn at the inlet end of the cooling rail and the position of the yarn at the outlet end of the cooling rail is substantially 90°. As the yarn advances over the cooling surface of the cooling rail, this 90° out-of-phase displacement in the two end regions prevents at all times that the entire length of the yarn advancing along the cooling rail assumes a position of rest or reversal, and the yarn will come only into point contact with a lateral boundary if one is present. This avoids having phases occur, in which the yarn is moved with its length section momentarily passing over the cooling surface into wetted regions.

Preferably, the cooling surface of the cooling rail is convexly curved in the longitudinal direction, i.e., the direction of the advancing yarn. Transversely to the longitudinal direction, the cooling surface is preferably flat or convex. However, it may also be slightly concave. To the end that the yarn does not rise from the cooling surface, it will be necessary that with a concave cooling surface, the highest point contacted by a yarn in an end region lie deeper than the point located in the highest region between the end regions and being cross sectionally in the lowest position, when viewed along the yarn path through the cooling rail.

To realize an effective cooling, a channel with a coolant flowing therethrough may be provided, preferably below the cooling apparatus constructed as a cooling rail. To further avoid that the temperature falls below the dew point or freezing point on any outward directed surface of the cooling apparatus, which would result in having condensate drip into the machine region, or that ice builds up, a further preferred embodiment of the cooling rail includes a cover and is insulated as a whole, so that the temperature falls at no point of the outer surface of the cooling apparatus below such limits. The cover allows the cooling performance to be reduced, since it decreases the contact with room air.

Where forced cooling on the cooling rail is employed, the apparatus may be coupled with a yarn sensor, so that upon a yarn break a signal can be generated and be practically evaluated for purposes of interrupting a supply of coolant through the channel in the cooling rail and thus save energy. When the temperature falls below the dew point or freezing point limit, the flow of coolant must always be interrupted, when no yarn advances, since a continuous wiping is absent.

The method of cooling an advancing yarn is realized by creating a back and forth relative movement between the cooling rail and the advancing yarn in the end regions of the cooling rail. The relative movement is shifted in phase, so that the cooling rail and/or the yarn are moved relative to one another such that the yarn performs a sweeping motion similar to that of a pendulum, with respect to the cooling surface of the cooling rail. Thus, the yarn sweeps over the cooling surface by constantly varying the particular position of an imaginary point which does not move along with the yarn and which, when related to the direction of the advancing yarn, moves back and forth on the side of the cooling surface of the cooling rail. The phase shift between the entry position and exit position of the advancing yarn into and out of the cooling surface, preferably, amounts to 90°. This prevents the yarn from being subjected to a rest or reversal position for the entire yarn length sweeping over the cooling surface. Since, moreover, the yarn comes only into point contact with the lateral boundary of the cooling surface, it is likewise prevented from immersing into a possibly forming wall of dirt, condensate or ice.

BRIEF DESCRIPTION OF THE DRAWINGS

Some of the objects and advantages of the present invention having been stated, others will appear as the description proceeds, when considered in conjunction with accompanying drawings, in which.

DETAILED DESCRIPTION OF THE PREFERRED EMBODIMENTS

Figure 1C:
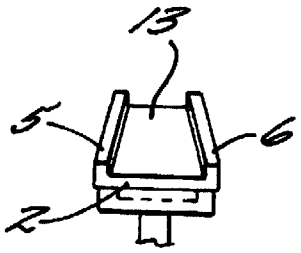
FIGS. 1A, 1B and 1C are front, side, and end views, respectively, of a cooling rail which embodies the features of the present invention.
Figure 1B:
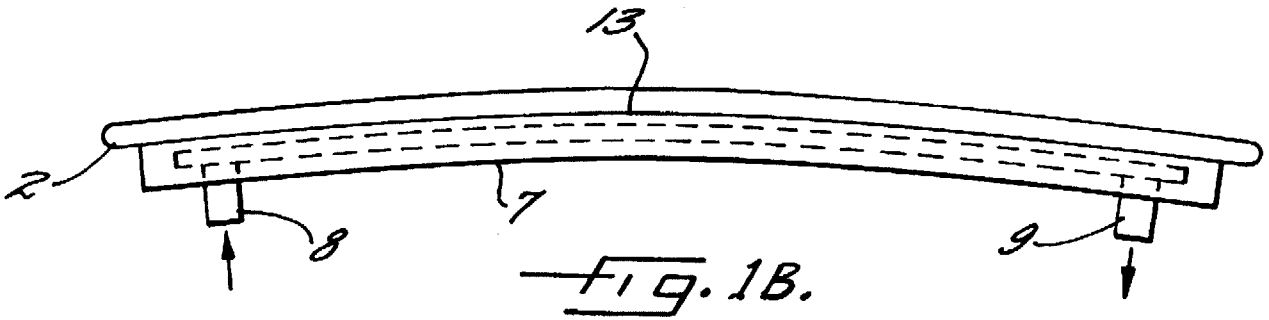
Figure 1A:
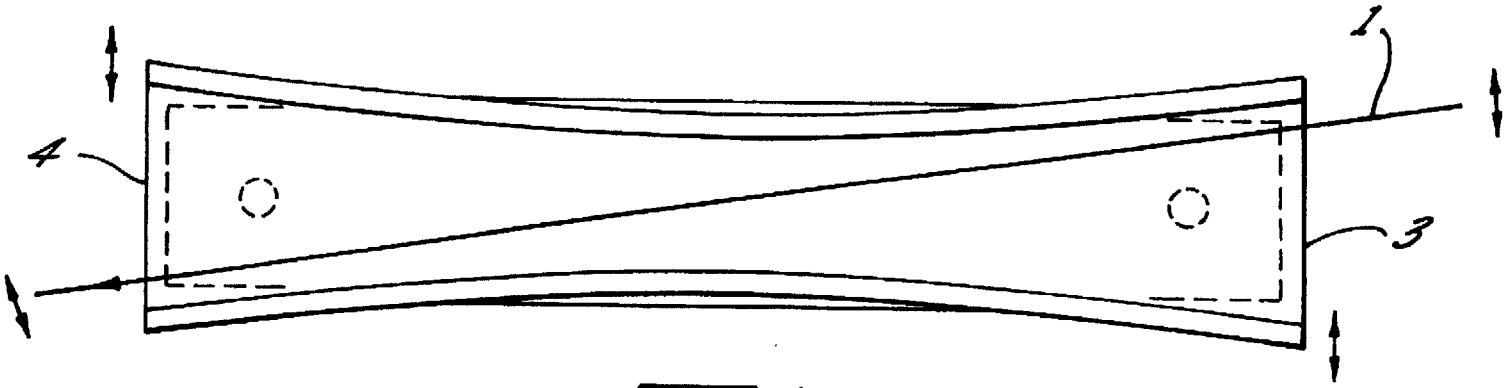

FIGS. 1A, 1B, and 1C are three views of a cooling apparatus which embodies the present invention, without an insulation. The cooling apparatus comprises an elongate cooling rail 2, which defines a longitudinal direction and opposite ends 3 and 4. The rail 2 also defines an upper cooling surface 13, which has an approximately cylindrically curved region that is contacted by the advancing yarn 1. The advancing yarn 1 is guided longitudinally along the surface 13 by suitable guides (not shown in FIGS. 1A, 1B and 1C), and means as further described below is provided for effecting back and forth relative transverse movement between the yarn and the surface 13 adjacent each of the opposite ends of the rail. As a result of this relative movement between yarn 1 and cooling rail 2, the yarn 1 sweeps over the cooling surface 13 in the motion of a pendulum, with only one point of the yarn contacting, in accordance with the amplitude, the outermost region at inlet end 3 or at outlet end 4, and without forming a point of rest or reversal while changing the direction of the yarn relative to the cooling surface.

The cooling rail 2 is bounded by side walls 5, 6, the center region of the cooling rail being recessed in accordance with the relative movement performed by the yarn on cooling surface 13, so that the side walls 5 and 6 assume geometrically the shape of two hyperbolas with opposing vertices. However, any other shape is possible. As the yarn 1 sweeps over the contact region in accordance with the aforesaid pendulum motion, condensate or ice is constantly wiped off the contact region or cooling surface 13, when the surface temperature of the cooling surface is below the respective limit value of about 10° C. or 0° C. The phase shift of yarn 1 or the movement of the yarn relative to the cooling surface is realized, in that the position of yarn 1 at inlet end 3 is shifted 90° out of phase from the position of the yarn at outlet end 4. This phase shift can be realized by a kind of reciprocating motion of the yarn at the ends of the rail, or by a collective movement of the rail on two bars relative to the yarn.

The lateral boundaries of the cooling surface are selected such that the entire, uninsulated, i.e. cooled region is wiped over. This allows to prevent the yarn, while sweeping over the cooling surface, from immersing with its entire length in a wall of condensate or dirt forming on the sides of the cooling surface.

To increase the cooling effect of the apparatus, a forced cooling system is provided in the form of a channel 7 arranged on the underside of cooling rail 2. Accordingly provided are an inlet end 8 and an outlet end 9 for the coolant. Preferably, the coolant flows through channel 7 in a direction counter to the advance of the yarn. However, the unidirectional flow principle is likewise possible. Such a cooling rail 2 makes it thus possible that the yarn uniformly wipes off and carries away the moisture that condensates or ices on the surface. Also, only water previously removed from the ambient air is returned to the air by evaporation, so that the process is neutral with respect to the climate, and there is no need to provide additional equipment for effecting possible moisture controls.

Figure 2C:
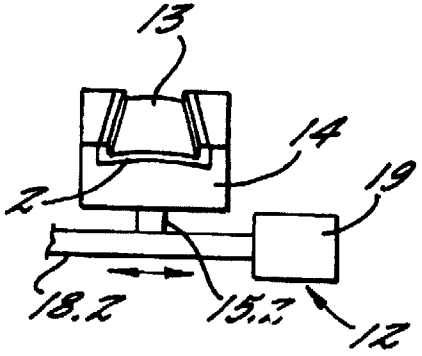
FIGS. 2A, 2B and 2C are front, side, and end views of a second embodiment of a cooling rail in accordance with the present invention.
Figure 2B:
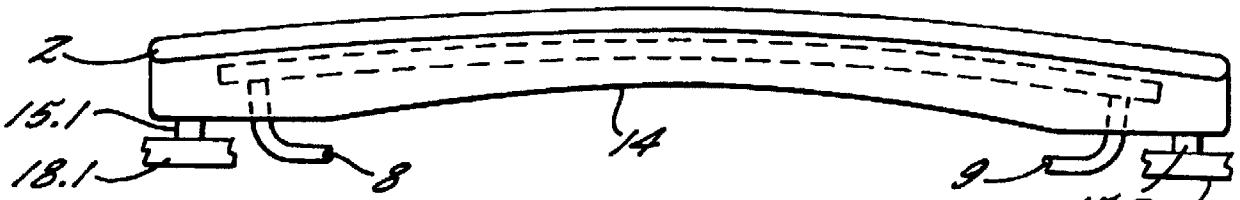
Figure 2A:
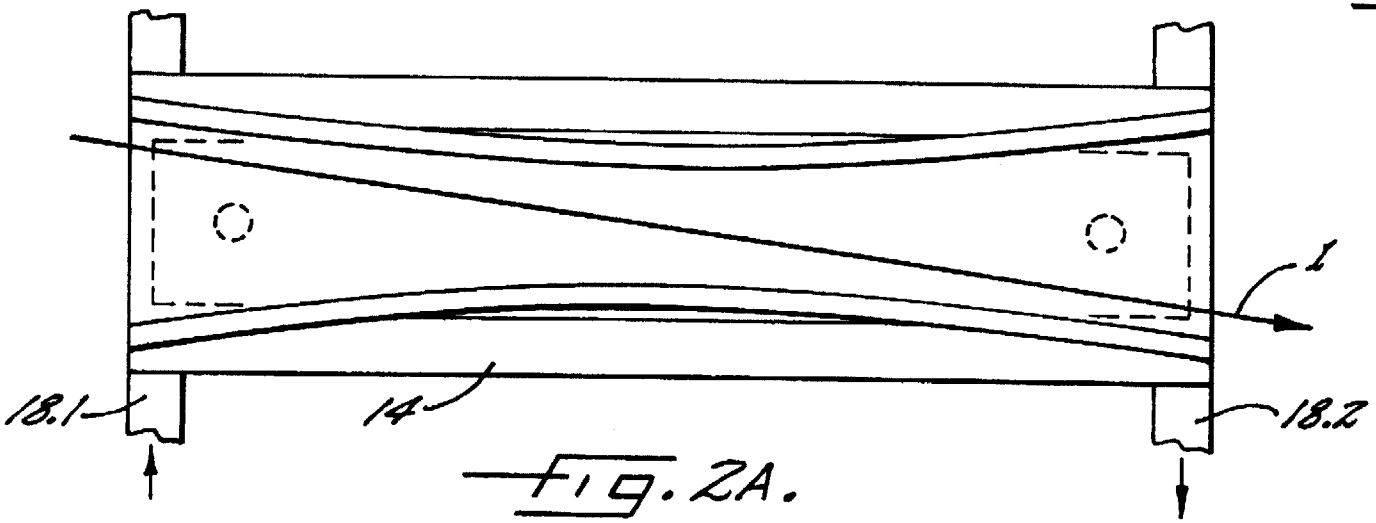

To ensure that no condensate forms on the outer surfaces of the cooling apparatus which are not covered by the yarn, and which may drip into the region of the machine, an insulated cooling rail 2 as shown in FIGS. 2A, 2B and 2C may be provided. The basic structure of this insulated rail corresponds to that of FIGS. 1A, 1B, and 1C, except that the outer surfaces are provided with an insulation 14, so that the temperature never falls below the dew point or freezing point. Such an insulation 14 of cooling rail 2 serves to further decrease losses in the cooling performance.

In the embodiment of FIGS. 2A, 2B and 2C, the cooling rail is connected in its inlet and outlet regions via cross members 15.1 and 15.2 respectively to a guide bar 18.1 and 18.2. Each of the guide bars 18.1 and 18.2 is driven by a drive unit 19, so that they perform an oppositely directed reciprocation. The guide bars 18.1 and 18.2 are mounted on a machine frame not shown. This configuration of the cooling apparatus has the special advantage that, in an end region, several, parallel arranged cooling rails can be moved simultaneously, each by a guide bar.

Figure 3A:
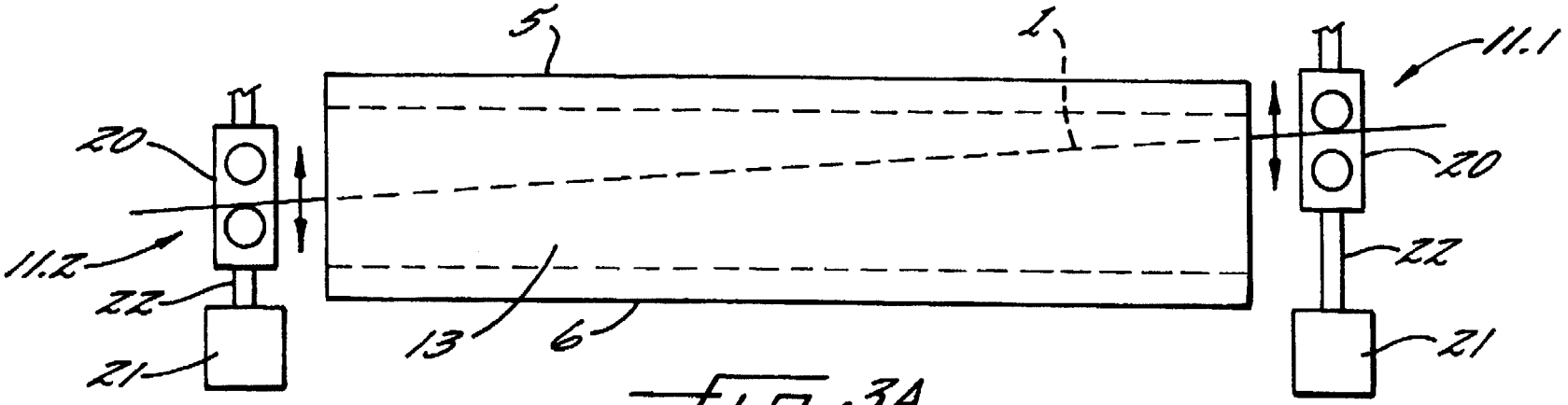
FIGS. 3A and 3B are front and end views, respectively, of a further embodiment of a cooling rail in accordance with the present invention.
Figure 3B:
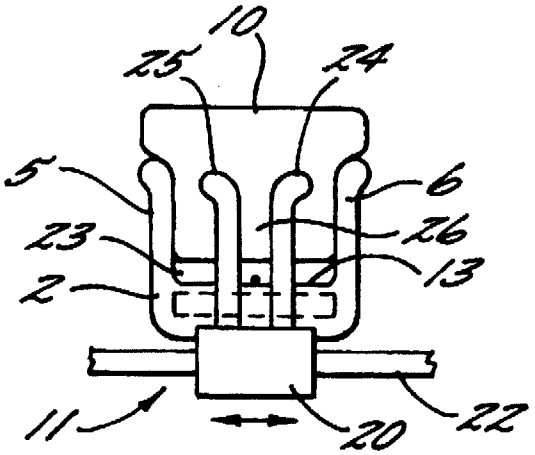

To further decrease losses in the cooling performance, the cooling rail 2 may be provided with a cover 10 that is preferably hinged and likewise insulated. This cover leads to obtaining consistent temperature conditions in the region which is covered by the yarn advancing on cooling surface 13 of cooling rail 2, as shown in FIGS. 3A and 3B. As result of the illustrated cover 10, the region that is covered by the yarn 1 takes the form of a slot-like channel 23. The air entrained by the yarn 1 as it advances through this channel 23, carries along the water that is needed for the formation of condensate and/or ice. The rail is cooled by circulating water which is conducted through cooling channel 7. Only when the surface temperature of the cooling surface falls below 0° C., will it be necessary to operate with a cooling sole circulation. In this process, −5° C. is possible and quite common in cryogenic engineering.

As seen in FIG. 3A, the pendulum-like motion is generated by yarn deflection devices 11.1 and 11.2, the advancing yarn 1 performing a movement in accordance with the invention relative to the cooling surface 13. FIG. 3A also illustrates that the position of the yarn at the inlet end is shifted 90° out of phase from the position of the yarn at the outlet end.

The yarn deflection devices 11.1 and 11.2 each consists of a yarn guide 20, which has two guide edges 24 and 25 extending through the plane of the yarn path. The guide edges 24 and 25 are arranged parallel at a distance from each other, so that they form between them a guide slot 26 accommodating the advancing yarn. The yarn guide 20 is attached to a yarn deflection arm 22, and the yarn deflecting arm 22 is reciprocated in a straight line by means of a traversing unit 21, the stroke being preferably not greater than the width of the cooling surface crosswise to the yarn path. The yarn 1 is deflected by the yarn deflection device 11.1 in the inlet region and by the yarn deflection device 11.2 in the outlet region. To generate the pendulum-like motion, the yarn guides 20 are moved in opposite directions, preferably at the same time.

To save energy, the coolant circulation system may be provided with a valve 29, which can be closed, when a yarn sensor 27 signals the absence of an advancing yarn.

Figure 4:
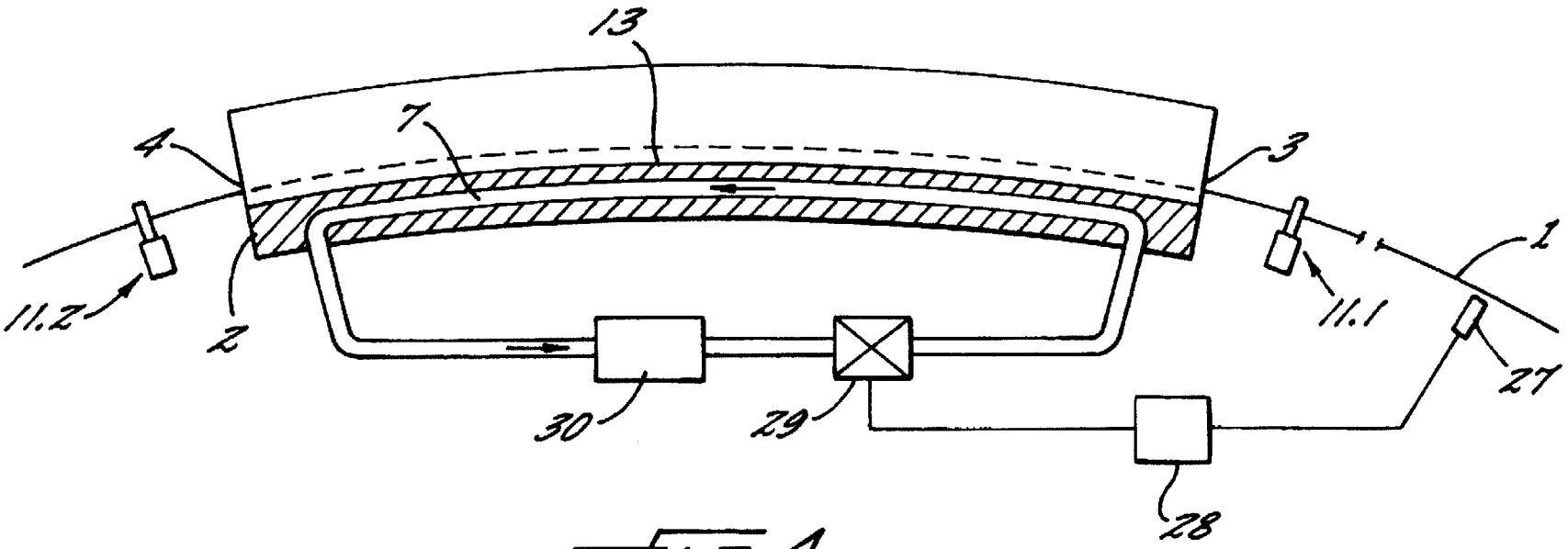
FIG. 4 is a sectioned side view of still another embodiment of a cooling rail in accordance with the present invention and which includes a sensor for detecting a yarn break.

Shown in FIG. 4 is a cooling rail 2, which is cooled by means of a coolant circulation system, the coolant being conducted through cooling channel 7. The coolant circulation system is operated by the unidirectional flow principle with the use of a coolant preparation system 30. Before entering into the cooling channel 7, the liquid coolant passes through the valve 29, which is controlled via a control unit 28. The control unit 28 is connected to the yarn sensor 27 which is positioned upstream of the cooling rail 2. The relative movement between the yarn 1 and the cooling rail 2 is generated by means of the yarn deflection devices 11.1 and 11.2.

In the event of a yarn break, the yarn sensor 27 generates a signal, which is supplied to the control unit 28. The control unit 28 converts the signal into a control pulse, and triggers valve 29, which interrupts the supply of coolant to cooling channel 7. Thus, not only is energy saved, but also condensate or ice is prevented from forming on cooling surface 13.

In the drawings and the specification, there have been set forth preferred embodiments of the invention, and, although specific terms are employed, the terms are used in a generic and descriptive sense only and not for the purpose of limitation, the scope of the invention being set forth in the following claims.

That which is claimed:

1. An apparatus for cooling an advancing yarn comprising:

an elongate cooling rail which defines a longitudinal direction and opposite ends, means for guiding the advancing yarn longitudinally along the cooling rail, and means for creating back and forth relative movement in a direction transverse to the longitudinal direction between the yarn and the cooling rail adjacent each of the opposite ends of the cooling rail and such that the relative movements adjacent the opposite ends of the cooling rail are out of phase.

2. The apparatus as defined in claim 1 wherein the cooling rail is convexly curved in the longitudinal direction.

3. The apparatus as defined in claim 2 wherein the cooling rail is flat in a direction transverse to the longitudinal direction.

4. The apparatus as defined in claim 2 wherein the cooling rail is convexly curved in a direction transverse to the longitudinal direction.

5. The apparatus as defined in claim 1 wherein said means for creating back and forth relative transverse movement between the yarn and the cooling rail includes means for controlling the amplitudes of the relative movement so that the amplitudes at the opposite ends of the cooling rail can differ.

6. The apparatus as defined in claim 1 wherein the cooling rail is stationary and said means for creating back and forth relative transverse movement between the yarn and the cooling rail comprises means for reciprocating the yarn transversely at each of the opposite ends of the rail.

7. The apparatus as defined in claim 1 wherein said means for guiding the advancing yarn acts to guide the yarn along a stationary path of travel along the cooling rail and wherein said means for creating back and forth relative transverse movement between the yarn and the cooling rail includes means for reciprocating the cooling rail transversely at each of opposite ends thereof.

8. The apparatus as defined in claim 1 wherein the back and forth relative movements at the opposite ends of the cooling rail are 90° out of phase.

9. The apparatus as defined in claim 1 wherein the cooling rail defines an upper surface adapted to engage the advancing yarn, and opposite longitudinal side walls along opposite sides of the upper surface.

10. The apparatus as defined in claim 1 wherein the cooling rail includes a longitudinally extending internal channel for circulating a coolant.

11. The apparatus as defined in claim 1 wherein the cooling rail defines an upper surface adapted to engage the advancing yarn, and further comprises an insulated cover overlying said upper surface.

12. The apparatus as defined in claim 1 further comprising sensor means for detecting a break in the advancing yarn.

13. A method for cooling an advancing yarn comprising the steps of:

providing an elongate cooling rail which defines a longitudinal direction and opposite ends, guiding the advancing yarn longitudinally along the cooling rail, and while creating back and forth relative movement in a direction transverse to the longitudinal direction between the yarn and the cooling rail adjacent each of the opposite ends of the cooling rail and such that the relative movements adjacent the opposite ends of the cooling rail are out of phase.

14. The method as defined in claim 13 wherein the step of creating back and forth relative transverse movement between the yarn and the cooling rail includes retaining the cooling rail stationary while reciprocating the yarn in a direction transverse to the longitudinal direction at each of the opposite ends of the rail.

15. The method as defined in claim 13 wherein the step of creating back and forth relative transverse movement between the yarn and the cooling rail includes retaining the advancing yarn in a stationary path of travel while reciprocating each of the ends of the cooling rail in a transverse direction.

16. The method as defined in claim 13 comprising the further step of cooling the cooling rail to a temperature below the dew point.

17. The method as defined in claim 13 wherein the back and forth relative transverse movements are continuous and in opposite directions at the same time.

18. An apparatus for cooling an advancing yarn comprising:

an elongate cooling rail which defines a longitudinal direction and opposite ends, means for guiding the advancing yarn along a stationary path of travel longitudinally along the cooling rail, and means for creating back and forth relative movement in a direction transverse to the longitudinal direction between the yarn and the cooling rail adjacent each of the opposite ends of the cooling rail and including means for reciprocating the cooling rail transversely at each of the opposite ends thereof.

19. A method for cooling an advancing yarn comprising the steps of:

providing an elongate cooling rail which defines a longitudinal direction and opposite ends, guiding the advancing yarn along a stationary path of travel longitudinally along the cooling rail, and while creating back and forth relative movement in a direction transverse to the longitudinal direction between the yarn and the cooling rail adjacent each of the opposite ends of the cooling rail and including reciprocating the cooling rail transversely at each of the opposite ends thereof.

* * * * *